US005310278A

United States Patent [19]

Kaczmarczik et al.

[11] Patent Number: 5,310,278

[45] Date of Patent: May 10, 1994

[54] PAVEMENT MARKERS WITH SILICONE ADHESIVE

[75] Inventors: James M. Kaczmarczik, Saint Paul; James E. Lasch, Oakdale; Gregory F. Jacobs, Woodbury, all of Minn.; David C. May, Roberts, Wis.; Daniel J. Willie, Minneapolis, Minn.

[73] Assignee: Minnesota Mining and Manufacturing Company, St. Paul, Minn.

[21] Appl. No.: 978,451

[22] Filed: Nov. 18, 1992

Related U.S. Application Data

[63] Continuation of Ser. No. 662,773, Feb. 28, 1991, abandoned.

[51] Int. Cl.[5] ..... E01D 19/00; E01D 19/06

[52] U.S. Cl. ..... 404/14; 404/16; 362/153.1

[58] Field of Search ..... 404/12, 14, 16; 362/153.1; 428/343, 352-353

[56] References Cited

U.S. PATENT DOCUMENTS

| | | | |
|---|---|---|---|
| 2,544,692 | 3/1951 | Kugler et al. . | |
| 2,601,016 | 6/1952 | Hendricks et al. . | |
| 2,708,192 | 5/1955 | Joesting et al. . | |
| 2,736,724 | 2/1956 | Maderni | 260/175 |
| 2,857,356 | 10/1958 | Goodwin | 260/42 |
| 2,956,904 | 11/1954 | Hendricks et al. . | |
| 3,332,327 | 7/1967 | Heeman | 94/1.5 |
| 3,451,537 | 6/1969 | Freeman et al. | 206/59 |
| 4,117,192 | 9/1978 | Jorgenson . | |
| 4,123,140 | 10/1978 | Ryan et al. | 404/12 X |
| 4,145,112 | 3/1979 | Crone et al. | 404/14 X |
| 4,223,067 | 9/1980 | Levens . | |
| 4,231,830 | 11/1980 | Ryan et al. | 404/14 X |
| 4,248,932 | 2/1981 | Tung et al. . | |
| 4,299,874 | 11/1981 | Jones et al. . | |
| 4,388,359 | 6/1983 | Ethen et al. . | |
| 4,415,615 | 11/1983 | Esmay et al. . | |
| 4,472,480 | 9/1984 | Olson . | |
| 4,490,432 | 12/1984 | Jordan . | |
| 4,567,073 | 1/1986 | Larson et al. . | |
| 4,613,534 | 9/1986 | Blizzard et al. | 52/2.23 X |
| 4,623,280 | 11/1986 | Stenemann | 404/94 |
| 4,626,127 | 12/1986 | May | 404/14 |
| 4,648,689 | 3/1987 | May | 404/14 X |
| 4,681,401 | 7/1987 | Wyckoff | 404/14 X |
| 4,736,048 | 4/1988 | Brown et al. . | |
| 4,751,140 | 6/1988 | Isihara | 428/324 |
| 4,873,140 | 10/1989 | McIntyre . | |
| 4,875,798 | 10/1989 | May . | |
| 4,876,141 | 10/1989 | Kobayashi et al. | 428/325 |
| 4,974,990 | 12/1990 | Anderson et al. . | |

FOREIGN PATENT DOCUMENTS

| | | |
|---|---|---|
| 35599 | of 0000 | European Pat. Off. . |
| 0354333A1 | 2/1990 | European Pat. Off. . |

OTHER PUBLICATIONS

Thomas J. Tangney, Silicone Pressure-Sensitive Adhesives for High Performance Applications.

Thomas J. Tangney, Sub-Ambient Pressure-Sensitive Adhesive Applications: The Advantages of Silicones.

Duane F. Merrill, Silicone Pressure-Sensitive Adhesives.

B. C. Copley, Dynamic Mechanical Properties of Silicone Pressure-Sensitive Adhesives.

*Primary Examiner*—Kenneth J. Dorner

*Assistant Examiner*—Nancy Mulcare

*Attorney, Agent, or Firm*—Gary L. Griswold; Walter N. Kirn; Robert H. Jordan

[57] ABSTRACT

A pavement marker includes an object, such as a sheet or a raised pavement marker body, having an upper surface useful as a pavement marking indicium and a lower surface, and a bottom layer of polyorganosiloxane pressure-sensitive adhesive in intimate contact with the lower surface. A pressure-sensitive adhesive laminate system for attaching a pavement marker to a roadway surface includes a first layer of pressure-sensitive adhesive material, such as a polyorganosiloxane adhesive, a second layer of pressure-sensitive adhesive material, and a layer of deformable material interposed between the first and second pressure-sensitive adhesive layers, wherein the deformable material of the interposed layer is characterized by high cohesive (shear) strength. A method of marking a pavement having a temperature below 15° C. includes providing a pavement marker of the invention and contacting the pavement with the pressure-sensitive adhesive and applying pressure to the top layer to bond the pavement marking material to the pavement.

3 Claims, 1 Drawing Sheet

PAVEMENT MARKERS WITH SILICONE ADHESIVE

CROSS-REFERENCE TO RELATED APPLICATION

This is a continuation of application Ser. No. 07/662,773, filed Feb. 28, 1991, now abandoned.

BACKGROUND OF THE INVENTION

The present invention relates to pavement marking materials which may be adhered to a roadway surface to provide traffic control marking. It also relates to adhesive layers useful in adhering pavement marking material to a roadway surface.

Pavement markings convey information to drivers and pedestrians by providing exposed visible and/or reflective surfaces which serve as indicia upon a roadway surface. In the past such a function was typically accomplished by painting portions of a roadway surface. Modern pavement marking materials offer significant advantages over paint such as dramatically increased visibility and/or reflectance, improved durability, and temporary removable marking options. Two examples of modern pavement marking materials are pavement marking sheet materials and raised pavement markers.

Continuous and skip lane stripings on highways and pedestrian crosswalk markings employ preformed pavement marking sheeting preferably comprising a wear-resistant top layer optionally overlying a flexible base sheet. The top layer is generally highly visible, may include reflective elements to enhance detection when illuminated by traffic at night, and serves as indicia when installed upon the roadway surface. Application of pavement marking sheeting to a roadway surface has typically been by contact cement or rubber-based pressure-sensitive adhesives.

Another example of a pavement marking is a raised pavement marker (i.e. a discreet marking structure with a rigid, semi-rigid or flexible marking body) which when applied to a roadway surface provides a raised surface. Often, the raised surface is both reflective and strategically oriented to enhance reflective efficiency when illuminated by traffic at night. In the case of rigid discreet markers, attachment of the body of each marker to the pavement surface has involved hot-melt adhesives or epoxy systems. Flexible body raised pavement markers have also been attached to pavement surfaces or pavement marking sheeting by soft butyl mastic materials.

In order to fulfill their function as indicia, both raised pavement markers and pavement marking sheeting must be applied to a rather troublesome substrate. That substrate, the roadway surface, varies widely in terms of surface properties because the underlying material may be concrete or asphalt, may be of varying age and temperature, and may, on occasion, be moist or damp or oily. Additionally, the roadway surface may vary in texture from rough to smooth. The substrate surface properties, therefore, represent a considerable challenge for adhesive attachment.

Some of the deficiencies associated with present pavement marking adhesives include: (1) inability to be applied due to limited adhesive tack at low temperature; (2) limited ability to accommodate surface roughness; (3) reduced durability, particularly at low temperature, when subjected to impact or shear; (4) increasing adhesion over time which in turn limits the duration of a period during which a temporary installation may be efficiently removed; and (5) staining of light colored concrete roadway surfaces by adhesives in removable markers. Additionally, particularly in the case of rigid body raised pavement markers, a rigid adhesive attachment to the pavement surface increases the susceptibility of the body of the marker to shattering upon impact by a vehicle tire. Further, inability of the adhesive to bridge gaps between a rigid raised pavement marker and a rough road surface may lead to early detachment of the marker from the roadway surface.

The practical significance of such deficiencies in adhesive systems is a tendency towards either inadequate initial bonding (i.e. through insufficient adhesive tack) or inadequate permanent bonding of a marking sheet to the roadway surface. Some pavement marking sheets have a somewhat elastic nature and their slow but progressive tendency toward recovery after initial application may exceed adhesive forces bonding the sheet to the pavement and result in the pavement marking sheet becoming detached. Once the pavement marking sheet becomes prematurely detached from a roadway surface, advantages such as more effective visibility and potentially longer service life cannot be realized. Similarly, a shattered or detached raised pavement marker will fail to serve in its intended function as an indicium. Further, inadequate adhesive tack at low temperature limits the application season in many locations which in turn leads to less efficiently marked highway projects.

In view of the above-described deficiencies associated with adhesion of pavement marking sheets or raised pavement markers to roadway surfaces, a desirable adhesive system would embody the following properties:

1. Extended temperature range for application.
2. Durability of application/adhesion.
3. Acceptable cost.
4. Efficient installation.

Additionally, if the system is to be removable from the pavement, an adhesive system would desirably embody the following properties:

1. Peel force does not drastically increase over time.
2. Non-staining to concrete pavement.

Additionally, in the case of rigid body raised pavement markers, an adhesive system would desirably embody the following properties:

1. Accommodates irregularities between the pavement surface and the rigid body of a raised pavement marker.
2. Protects or cushions a raised pavement marker from the shock of impact from a vehicle tire.

The present invention, as disclosed below, satisfies these requirements with silicone pressure-sensitive adhesive systems which are highly useful for pavement marking tapes and raised pavement markers.

SUMMARY OF THE INVENTION

Polyorganosiloxane pressure-sensitive adhesives ("silicone pressure-sensitive adhesives") have been known for many years but are believed not to have been previously employed as adhesives for pavement markers such as pavement marking sheets or raised pavement markers. At least three factors may have discouraged use of silicone pressure-sensitive adhesives in adhesive systems for pavement markers.

First, silicone pressure-sensitive adhesives are relatively more costly than adhesives which have been used for application of pavement markers to pavement.

Second, silicone pressure-sensitive adhesives have a general reputation for only moderate adhesive properties such as tack and peel strength rather than outstanding adhesive tack and peel which would appear to be necessary by the desired property of durability of application/adhesion. Specifically, in comparison to adhesives commonly employed in this field (i.e. rubber resin pressure-sensitive adhesives), silicone pressure-sensitive adhesives generally are characterized by low tack and low peel adhesion at room or cold temperatures. Silicone pressure-sensitive adhesives are better known and have a good reputation as effective adhesives for highly demanding high temperature situations since, when crosslinked, their shear strength remains generally constant at high temperatures.

Third, silicone pressure-sensitive adhesives have a reputation for some adhesion to nearly all surfaces. Thus, any expectation of handling convenience would require the availability of appropriately coated release surfaces. Typically, release surfaces for silicone pressure-sensitive adhesives have been carried upon separate release sheets. Handling of separate release sheets during application of pavement markers to a roadway surface would be undesirable, particularly in the case of pavement marking sheets.

The present invention, in one embodiment, is a pavement marker. The pavement marker includes an object, which has an upper surface which is useful as a pavement marking indicium and a lower surface, and also includes a bottom layer of polyorganosiloxane ("silicone") pressure-sensitive adhesive underlying and in intimate contact with the lower surface. The object bearing the layer of silicone pressure-sensitive adhesive might be a pavement marking sheet or a raised pavement marker body.

In a preferred embodiment, the pavement marker is a pavement marking sheet including a base layer and a top layer which is overlying the base layer. Preferably, the overlying top layer includes a visibility enhancing pigment and/or partially embedded and partially exposed elements such as reflective elements and/or skid resisting elements.

Preferably, the pavement marking sheet also includes a layer of adhesive (i.e. bulk adhesive) which underlies the base layer and defines the bottom surface of the sheet. The bulk adhesive layer of the sheet is interposed between the base layer of the sheet and the polyorganosiloxane pressure-sensitive adhesive layer and is in contact with the polyorganosiloxane layer and optionally and most preferably, in contact with the base layer of the sheet.

In order to better adhere to rough textured roadway surfaces, it is advantageous to supply a thicker adhesive film which allows intimate contact with more of the roadway surface. In the absence of an adhesive layer defining the lower surface of the sheet, the bottom layer of silicone pressure-sensitive adhesive has a thickness of from about 3.0 to about 30 mils (76–760 micrometers). If an adhesive layer defining the lower surface of the sheet is present, then the combined thickness of the adhesive layer of the sheet and the bottom layer of silicone pressure-sensitive adhesive is preferably from about 3.0 to about 30 mils (76–760 micrometers). In such a combination, the bottom layer of silicone pressure-sensitive adhesive has a thickness of from about 0.5 to about 10 mils (13–254 micrometers). The combination of a bottom layer of silicone pressure-sensitive adhesive and the lower adhesive layer of the sheet provides the advantage of several of the desirable properties of silicone pressure-sensitive adhesive while avoiding much of the higher material cost of silicone pressure-sensitive adhesive. Further, employing a thin layer of silicone pressure-sensitive in combination with an adhesive layer of the sheet minimizes some of the less desirable properties of the silicone pressure-sensitive adhesive. In particular, in such an arrangement, the detrimental contribution of the relatively weak shear (cohesive) strength of the uncrosslinked silicone pressure-sensitive adhesive is minimized and instead, the lower layer adhesive of the sheet tends to contribute its relatively stronger shear (cohesive) strength. The combination of a thin silicone pressure-sensitive adhesive underlying and in contact with a conventional rubber-resin adhesive, offers the advantages of material cost and shear (cohesive) strength close to that of the relatively less expensive rubber-resin adhesive, along with the tack, peel, temperature and time independence, and nonstaining characteristics of the silicone pressure sensitive adhesive.

Preferably, the silicone pressure-sensitive adhesive, when coated as a 3 mils (76 micrometers) thick layer on a 2 mils (51 micrometers) thick polyester backing, is characterized by a 90 peel strength of from about 1.0 to about 6.0 lbs. per inch width (1.8–10.5 Newtons (NT) per cm) from stainless steel at a peel rate of 21.4 inches (54 cm) per minute at 21° C. and more than about 0.25 lbs. per, inch width (0.4 NT per cm width) when measured at 2° C.

Preferably, the silicone pressure-sensitive adhesive, when coated as a 3 mils (76 micrometers) thick layer on 2 mils (51 micrometers) thick polyester backing, is characterized by a twin cylinder tack strength (as explained below), during a 21.4 inch per minute (54 cm/min) pull rate in a standard tensile strength measuring device, of at least about 0.75 lbs. per inch width (1.3 NT per cm width) at 21° C. and at least about 0.5 lbs. per inch width (0.8 NT per cm width) when measured at 2° C.

A preferred silicone pressure-sensitive adhesive is prepared from a polydimethylsiloxane gum. The preferred silicone pressure-sensitive adhesive is substantially nonstaining to concrete pavement. By "nonstaining to concrete pavement" is meant that subsequent to removal after six months application to concrete pavement, no visually objectionable contrasting mark remains on the concrete pavement.

Additionally, the present invention includes a pressure-sensitive adhesive laminate for attaching a pavement marker to a roadway surface. The pressure-sensitive adhesive laminate system includes a first layer of pressure-sensitive adhesive material, a second layer of pressure-sensitive adhesive material and a layer of deformable material interposed between the first and second pressure-sensitive adhesive layers. The interposed layer of material is characterized by high cohesive strength and high deformability. Preferably, the interposed material is a foamed acrylic adhesive. Preferably, one of the adhesive layers of the pressure-sensitive adhesive laminate includes an acrylic based adhesive. Most preferably, one of the adhesive layers of the pressure-sensitive adhesive laminate includes a polyorganosiloxane adhesive. Most especially preferred is an embodiment in which a polyorganosiloxane layer is used to contact and bond to a roadway surface.

The interposed deformable layer adapts to uneven substrate surfaces to facilitate dependable bonding and may also serve to absorb and/or redistribute a significant portion of the impact or shock of vehicle tires striking the pavement marker. The laminate adhesive is particularly useful for attaching rigid raised pavement markers to a roadway surface. It supports the lower surface of the marker.

The present invention also includes a raised pavement marker including a rigid body having an upper surface useful as a marking indicia and having a base surface; a deformable layer having a first surface supporting the base surface of the rigid body; and a silicone pressure-sensitive adhesive layer laminated to a second surface of the deformable layer.

The present invention also includes a method of preparing pavement markers and a method of marking a pavement with a roadway surface below 15° C.

These figures, which are idealized, are not to scale and are intended to be merely illustrative and non-limiting.

DETAILED DESCRIPTION OF THE PREFERRED EMBODIMENTS

The present invention, in one embodiment, is a pavement marker. The pavement marker includes an object (such as a sheet or backing), which has an upper surface useful as a marking indicium and a lower surface, and a bottom layer of polyorganosiloxane ("silicone") pressure-sensitive adhesive in intimate contact with the lower surface of the sheet. Pavement markers according to this invention are useful as pavement marking sheets or tapes and are suited to application to roadway surface substrates over a wide range of temperatures, particularly including lower temperatures than those temperatures at which the pressure-sensitive adhesives currently used in the pavement marking industry. Specifically, the present invention facilitates application of pavement marking sheets or tapes to roadway surfaces at temperatures of 2° C. Additionally, pavement markers of this invention bond more effectively to difficult surfaces then do prior art pavement markers.

By "pressure-sensitive adhesive" herein is meant those viscoelastic materials which, in solvent free form, remain aggressively and permanently tacky and will adhere to surfaces tenaciously after the application of only very light manual pressure. By "silicone pressure-sensitive adhesive" or "polyorganosiloxane pressure-sensitive adhesive" herein is meant pressure-sensitive adhesive materials formed from a silicone "gum" structure and a silicone "resin" structure. Typically, the silicone gum and silicone resin are chemically linked by a condensation reaction. Silicone gum structures may include methyl and/or phenyl moieties. The ratio of silicone resin to silicone gum which is used in the silicone pressure sensitive adhesive may vary as long as the product is tacky at room temperature. In the particular case of silicone pressure-sensitive adhesives intended for application to roadway surfaces at or below 15° C., the silicone pressure sensitive adhesive product should be tacky at the intended application temperature. A suitable test method for measuring tack at selected temperatures is described below. Silicone pressure-sensitive adhesive films may also be further crosslinked, for example, through the use of benzoyl peroxide or 2,4,dichlorobenzoyl peroxide or a rare metal catalyst. Crosslinking of films tends to increase the cohesive strength and resistance to shear but with loss of tack and sometimes loss of peel strength. The Dexter patent, U.S. Pat. No. 2,736,724 and the Goodwin patent, U.S. Pat. No. 2,857,356, both of which are incorporated herein by reference, represent significant early work in the field in silicone pressure-sensitive adhesives.

Figure 1:
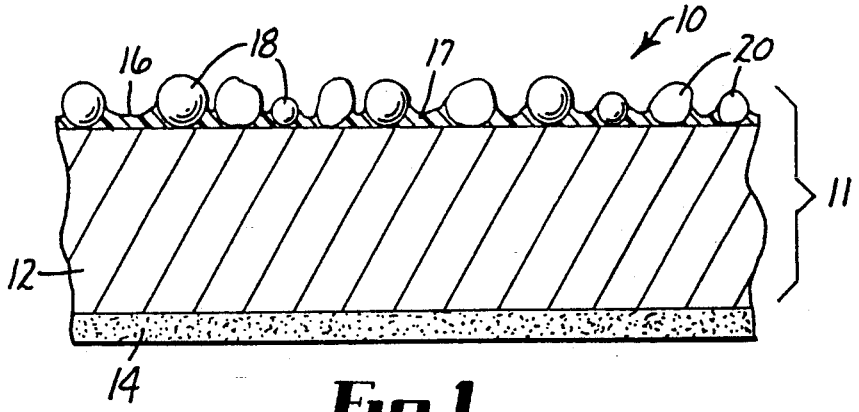
FIG. 1 is a schematic sectional view of a pavement marking sheet of this invention.

In one embodiment, a pavement marker 10, as shown in FIG. 1, includes a sheet 11 and a bottom layer 14. The sheet 11, has a base layer 12 and further has an upper surface 16, which is useful as a marking indicium. In the embodiment shown, the upper surface 16 is the surface of an optional top layer 17 overlying base layer 12. The top layer 17 may be formed of a wide range of polymeric materials such as, for example, polymers including polyamides, polyurethanes, epoxies, polyesters, and vinyls and so forth. Preferably, the top layer 17 has a thickness of from about 3 to about 90 mils (76–2300 micrometers); more preferably, from about 3 to 14 mils (76 to 358 micrometers); and most preferably, about 5 mils (125 micrometers). Suitable sheets 11, with separate base layers 12 and overlying top layers 17 providing upper surface 16, are disclosed in the Jorgenson patent, U.S. Pat. No. 4,117,192, incorporated herein by reference.

The sheet 11 has upper surface 16 which is useful as a marking indicium and preferably includes reflecting elements 18 and/or skid-resisting particles 20. Preferably, the top layer 12 also includes a visibility enhancing pigment, such as, for example, titanium dioxide. Sheets employing dead soft aluminum are also well known and suitable for use in the present invention.

In a variation of this embodiment, pavement markers which obliterate or temporarily cover existing road-markings (such as unwanted paint or marking tape which can not be easily removed) by application over the unwanted marking and thereby providing a flat black or gray surface 16 are also known and considered within the scope of this invention.

The bottom layer 14 includes a silicone or polyorganosiloxane containing pressure-sensitive adhesive. When directly adjoining the base layer 12, the bottom layer 14 has a thickness of from about 3.0 to 30 mils (76–760 micrometers), preferably a thickness of from about 4.0 to about 15 mils (100–380 micrometers) and most preferably a thickness of from about 5.0 to about 10 mils (127–254 micrometers). The bottom layer 14 may optionally include a reinforcement means to increase tensile strength and thereby enhance removability, such as, for example, a scrim or fibrous web as taught in the Jones, et al. patent, U.S. Pat. No. 4,299,874, incorporated herein by reference.

Figure 2:
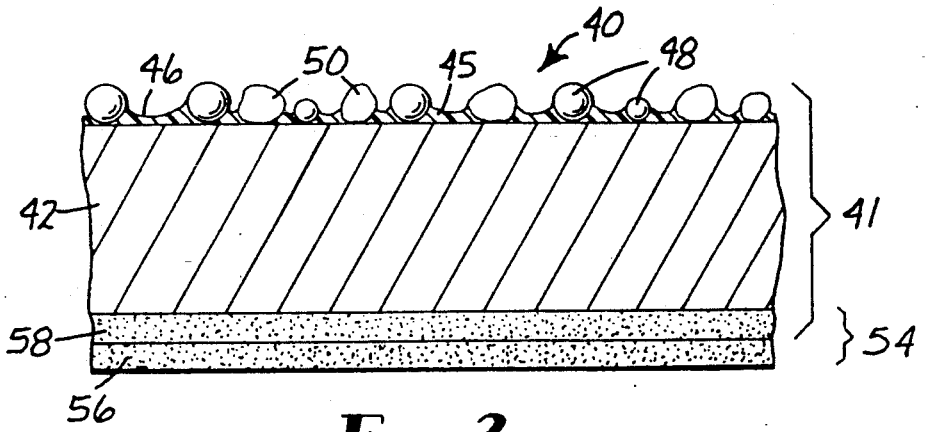
FIG. 2 is a schematic sectional view of another pavement marking sheet of this invention.

In another preferred embodiment, as illustrated in FIG. 2, a pavement marker 40 has a sheet 41, with a base layer 42, an optional top layer 45 which provides an upper surface 46, useful as a marking indicium and carrying partially embedded and partially exposed reflective elements 48 and/or skid-resisting particles 50. Sheets employing dead soft aluminum, which is relatively temperature independent in desirable conformance properties, are also well known and suitable for use in the present invention. The sheet 41 also includes a bulk layer of adhesive 58 underlying the base sheet 42. The adhesive layer 58, of the sheet 41 may be any of the adhesive layers typically provided with pavement marking sheets, for example, the butadiene rubber-based rubber-resin pressure-sensitive adhesive disclosed in example 5 of the Freeman patent, U.S. Pat. No. 3,451,537, incorporated herein by reference. An object, specifically a backing or sheet, which may be employed in forming a pavement marker of this invention is the construction disclosed in the Tung patent, U.S. Pat. No. 4,248,932, or the Ethen patent, U.S. Pat. No. 4,388,359, both of which are incorporated herein by reference.

The bottom layer 56 of polyorganosiloxane pressure-sensitive adhesive is in contact with the lower surface of adhesive layer 58. Layer 58 may be described as defining the lower surface of the sheet 41 and interposed between the base layer 42 and the bottom layer 56. Preferably, the adhesive layer 58 and base layer 42 are in contact with each other, however, other layers may also be present. Further, a reinforcing scrim may be present within the adhesive layer 58 in order to facilitate removability by increasing tensile and tear strength. The combination 54 of the bottom layer 56 of silicone pressure-sensitive adhesive and adhesive layer 58 has a thickness of from about 3 to about 30 mils (76–760 micrometers). In the combination 54, the bottom layer 56 of silicone pressure-sensitive adhesive has a thickness of from about 0.5 to about 10 mils (13–152 micrometers), preferably from about 2.0 to about 6.0 mils (51–152 micrometers) and most preferably from about 2.0 to about 3.0 mils (51–76 micrometers).

Silicone pressure-sensitive adhesives are costly relative to other common pressure-sensitive adhesives. Generally, for the purposes of the present invention, it is economically desirable to use as thin a layer of silicone pressure-sensitive adhesive as possible and yet still achieve the overall goals of the invention. This has the additional advantage of minimizing the detrimental effects of the relatively weak shear (cohesive) strength of uncrosslinked silicone pressure-sensitive adhesives and generally substituting the relatively stronger shear (cohesive) strength of the less costly traditional bulk adhesive of the sheet.

Suitable silicone pressure-sensitive adhesives are those polyorganosiloxane pressure-sensitive adhesives which exhibit pressure-sensitive adhesive behavior at temperatures from 0°–50° C., have improved impact properties, and form adhesive bonds at low temperatures when compared to pressure-sensitive adhesives which have conventionally been used in pavement marking tapes.

Preferred polyorganosiloxane pressure-sensitive adhesives enable effective application and adhesion of tapes to roadway surfaces at temperatures significantly lower than those previously accepted as the norms for roadway marking tape application. However, the low temperature advantage of this invention may only be fully available when used in conjunction with pavement marking sheets (such as Foil based tapes) which also remain flexible and conformable at low temperature.

Suitable silicone pressure-sensitive adhesive, when coated as a 3 mils (76 micrometers) thick layer on a 2 mils (51 micrometers) thick polyester backing, is characterized by a 90° peel strength of from about 1.0 to about 6.0 lbs. per inch width (1.8–10.5 NT per cm) from stainless steel at a peel rate of 21.4 inches (54 cm) per minute at 21° C. and the peel strength is more than 0.25 lbs. per inch width (0.4 NT per cm width) when tested at 2° C. When performing the above peel tests, the sample is laminated to a stainless steel panel using two passes of a hard rubber (70 shore A durometer) 1.5 inch diameter (3.8 cm) roller and 5 lbs. of pressure. A dwell time (typically 5 minutes) is allowed before peeling. Low temperature testing is done in a 2° C. cold room and all equipment and material is at 2° C. so that application, dwell and removal occur at low temperature.

Suitable silicone pressure-sensitive adhesive, when coated as a 3 mils (76 micrometers) thick layer on 2 mils (51 micrometers) thick polyester backing web, is characterized by a twin cylinder tack strength (as explained below), during a 21.4 inch per minute (54 cm/min) pull rate in a standard tensile strength measuring device, of at least about 0.75 lbs. per inch width (1.3 NT per cm width) at 21° C. and at least about 0.5 lbs. per inch width (0.8 NT per cm width) when measured at 2° C.

Twin Cylinder Tack Test

Figure 3:
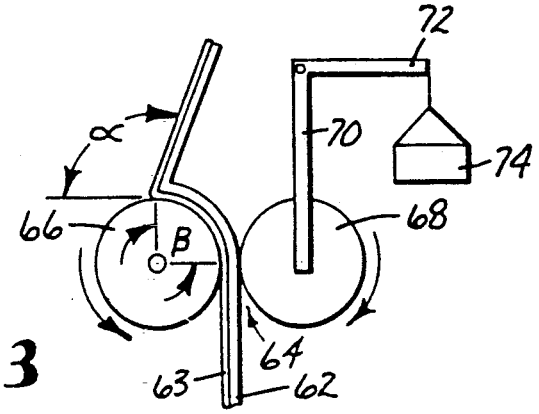
FIG. 3 is a schematic side view of a twin cylinder tack testing apparatus.

The twin cylinder tack test provides a simple measure of the tack in an adhesive sample. An apparatus or jig for performing the test is schematically shown in FIG. 3 as 60. The test is performed as follows. A strip of web 62 coated on one side with an adhesive sample 63 is continuously pulled through a nip 64 between a stainless steel roller 66 and a rubber roller 68. The coated side of the web 62 faces the stainless steel roller 66. During the time the web is pulled through the nip, the successive portions of the coating of adhesive 63 first contact the surface of the stainless steel roller 66, then after a brief dwell time are peeled from the surface by the web 62. The test is most conveniently performed with the test jig 60 mounted in a standard tensile testing machine (not shown).

The testing jig 60 consists of two horizontally mounted, parallel, free-rolling cylinders 66 and 68. One of the cylinders 66 has a stainless steel surface; the other cylinder 68 has a rubber surface with a hardness of about 50 when measured by Shore A Durometer. The cylinder diameters for the testing jig are both 1.5 inches (3.8 cm). The length of both cylinders is 3 inches (7.6 cm). The rubber coated cylinder is carried on a hinged support 70 so that it can be brought into contact with the stainless steel cylinder 66 and form a nip 64 with zero loading force. The hinged support 70 also includes a rigid perpendicular projecting lever 72 as a means of loading the rubber cylinder toward the nip with a known static force. The loading weight 74 is hung on the lever 72 with a loading moment such that the gravitational force exerted on the hanging weight 74 is multiplied by a factor of 1.25 when the force at the nip 64 is determined. The two parallel cylinders 66 and 68 are aligned such that in pulling the test sample 63 through the nip 64, the direction of motion of the end of the test sample is tangential to both rolls at their point of contact (i.e. the web is pulled as if it were traveling straight through the nip).

A test sample consisting of a 1 inch (2.54 cm) wide web 62 coated on one side with pressure-sensitive adhesive 63 is placed in the nip 64 of the testing jig with the adhesive side of the sample in contact with the stainless steel cylinder 66. The rubber cylinder 68 is loaded against the web or backing support 62 of the test sample using a 5 lbs. (2.27 Kg) weight 74. This in turn generates a loading force at the nip 64 of about 6.25 lbs. (2.84 Kg). One end of the test sample is gripped using a standard tensile tester and the test sample is pulled through the nip 64 of the testing jig 60 at a constant rate of, for example, about 18 inches per minute (46 cm/min). The force required to pull the sample 63 through the testing jig 60 is measured. The average force per unit width (i.e. 1.0 inch (2.54 cm)) of sample is the twin cylinder tack value for an adhesive.

During the test, the sample 63 actually remains temporarily in contact with the steel roller for some distance, for example about 0.25 of the circumference of the roll. During this contact or dwell time the angle between the free tape web and the stainless steel roller increases, until the force on the free tape web overcomes the recently formed bond to the stainless surface of cylinder 66 and the web 62 is peeled at a peel angle Á (i.e. angle between the web and a tangent to the surface at the point where contact is broken) of, for example, approximately 90°. This corresponds to, for example, a dwell length of about 1.18 inches (2.84 cm), at 18 inches per minute speed, a dwell time of about 3.8 seconds. Overall, the test is representative of the tack property of an adhesive sample 63 since it measures the peel force required shortly after a tacking application of a test sample of adhesive to a surface. The dwell time and peel angle Á vary somewhat as a function of speed and tack properties of the silicone pressure sensitive adhesive 63. Extremely tacky silicone pressure sensitive adhesives rapidly form bonds to the stainless steel surface. The test can easily be performed at various selected temperatures to measure the effectiveness of a pressure sensitive adhesive. The angle of arc of contact $\beta$ with the stainless steel cylinder 66 is a surprisingly sensitive measure of the aggressivity of tack of a pressure-sensitive adhesive. Particularly desirable silicone pressure-sensitive adhesives tend to have high angles of arc of contact $\beta$. Preferred silicone pressure-sensitive adhesives have angles of arc of contact $\beta$ of at least about 40° when pulled at 21.4 inches per minute (54 cm/min) at cold temperatures (i.e. about −1° C.). Most particularly preferred are silicone pressure-sensitive adhesives characterized by angles of arc of contact $\beta$ of at least about 60½° at 30° F. (−1° C.).

The preferred silicone pressure-sensitive adhesives for temporary, removable pavement markers are substantially nonstaining to concrete pavement. By "nonstaining to concrete pavement" is meant that subsequent to removal after six months application to concrete pavement, no visually objectionable contrasting mark remains on the concrete pavement.

An example of a suitable silicone adhesive is polydimethylsiloxane adhesive, such as for example, the polydimethylsiloxane adhesive ("PDMS") sold as Dow Corning X7-2675 Brand Silicone Adhesive available from Dow Corning Corp. of Midland, Mich. Other suitable pressure-sensitive adhesives are Dow Corning Q2-7406 and X2-7735 Brand Silicone Pressure-Sensitive Adhesives.

Silicone pressure-sensitive adhesives have several unique advantages when used in removable pavement marking tapes. These advantages include:

1. Significantly less stain on concrete road surface after tape removal.
2. Smooth peel from the roadway service (i.e., nonshocky peel from pavement surface, as opposed to the undesirable peel which has been generally been referred to as "slip-stick" peel)
3. Less build-up of adhesion over time while on the road (lower removal force required).
4. Reduced temperature dependence of tack and peel properties.

These advantages make tapes employing silicone pressure-sensitive adhesives particularly useful for temporary pavement markings.

Generally, pavement marking sheets which are to be used as pavement marking tapes are preferably stored and transported to highway project sites as rolls of tape. During the application and installation process, the tape is unwound from the roll.

In a further embodiment of this invention, handling of the pavement markers of the sheet type may be facilitated by the provision of a suitable low-adhesion backsize coating upon the upper surfaces 16 or 46. A suitable backsize coating is SYL-OFF TM Q2-7785 brand coating available from Dow Corning of Midland, Mich.

Alternatively, though less desirably, a disposable web bearing a suitable low-adhesion coating may be employed with sheet type markers. A suitable coating allows temporary contact with the silicone pressure-sensitive adhesive layer 14 or 56 without any undue diminishing of subsequent tack or other adhesive properties. Perfluoropolyether compounds, as disclosed in the Olson patent, U.S. Pat. No. 4,472,480, incorporated herein by reference, may be employed to provide such a coating.

Figure 4:
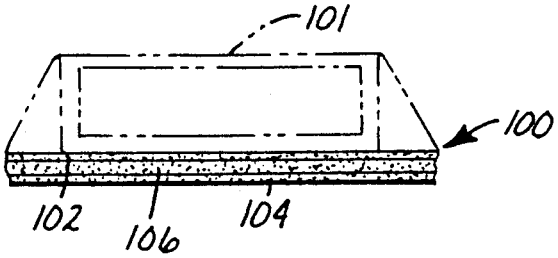
FIG. 4 is a schematic sectional view of an adhesive laminate of this invention.

The present invention also includes a pressure-sensitive adhesive laminate 100 as shown in FIG. 4. The laminate 100 includes a first layer of pressure-sensitive adhesive material 102 and a second layer of pressure-sensitive adhesive material 104 and a layer of deformable, optionally adhesive, material 106 interposed between the first layer 102 and the second layer 104.

The laminate is particularly useful for applying rigid or nearly rigid objects, such as raised pavement markers to roadway surfaces. Raised pavement marker bodies have been previously described in U.S. Pat. No. 4,875,798 and U.S. Pat. No. 4,974,990, both incorporated by reference herein. Older systems of applying rigid objects to roadway surfaces have employed hot-melt adhesive or epoxy adhesive. Butyl mastics have also been used as pressure-sensitive adhesives for rigid objects on roadway surfaces. These prior adhesive systems have been awkward to use, time consuming and generally not very durable.

The layer 106 of deformable material is capable of flowing sufficiently so as to increase contact between the layer of pressure sensitive adhesive 104 and the rough roadway surface. This enables a rigid marker (phantom 101) to be more securely bonded to the roadway surface. The deformable, optionally adhesive, layer 106 may also absorb at least some of the impact when a vehicle tire strikes a raised pavement marker employing the laminate 100. Adhesive layer 102 may be F9775PC acrylic adhesive available from the Minnesota Mining and Manufacturing Company of St. Paul, Minn. A suitable polyorganosiloxane pressure-sensitive adhesive is Dow Corning adhesive X7-2675 available from Dow Corning Chemical Company of Midland, Mich. In a most preferred embodiment, the layer of deformable adhesive material 106 is Y4253 foamed acrylic pressure-sensitive adhesive available from the Minnesota Mining and Manufacturing Company of St. Paul, Minn. Preferably, the layer of deformable adhesive material has a thickness from about 10 to about 250 mils (254–6350 micrometers), more preferably from about 20 to about 50 mils (508–1270 micrometers), and most preferably about 35 mils (890 micrometers). In the case of acrylic pressure-sensitive adhesives, such as F9775PC, the pressure-sensitive adhesive layers 102 or 104 should be from about 3 to about 8 mils (76–203 micrometers) in thickness and most preferably about 5 mils (127 micrometers) in thickness. In the case of polyorganosiloxane pressure-sensitive adhesive layers 104 or 102, such as X7-2675 silicone adhesive, available from Dow Corning, the layers should be from about 2 to about 8 mils (50–203 micrometers) and most preferably about 3 mils (76 micrometers) in thickness. The laminate could also be applied to a roadway and the pavement marker subsequently applied to the adhesive laminate on the roadway surface.

Although it may be feasible to employ a low adhesion coating upon the various upper surfaces of raised pavement markers, it is believed that handling of such articles will be facilitated by employing a disposable release sheet, since such a release sheet tends to protect the thin layer of silicon pressure-sensitive adhesive from dust and debris, whereas the upper surfaces (optionally rounded) of a first typical raised pavement marker would not fully protect an adhesive surface of a second raised pavement marker stacked atop the first.

EXAMPLE 1

Q2-7406 brand silicone pressure-sensitive adhesive, available from Dow Corning Corp. of Midland, Mich., was handspread coated as supplied in xylene solution onto a fluoropolymer release coated polyester liner (SCOTCHPAK TM 1022 release liner which is available from the Minnesota Mining and Manufacturing Company, St. Paul, Minn.) using a notched bar coater. The coating was allowed to air dry for about 10 minutes, dried for about 5 minutes at 70° C. and dried further for about 2 minutes at a temperature of 175° C. A sheet of unprimed uncoated polyester liner 2 mils (50 micrometers) in thickness was laminated to the Q2-7406 coating. The thickness of the Q2-7406 dry film was measured at 3.0 mils (76 micrometers).

EXAMPLE 2

Q2-7406 brand silicone pressure-sensitive adhesive solution, (Dow Corning Corp. of Midland, Mich.), was mixed with a solution of 10 wt % benzoyl peroxide in xylene so as to produce a solution with a benzoyl peroxide content of 1 wt % based on Q2-7406 solution (about 2 wt % based on adhesive solids.) This solution was handspread coated onto a fluoropolymer release coated polyester liner (SCOTCHPAK TM 1022 release liner available from the Minnesota Mining and Manufacturing Company, St. Paul, Minn.) using a notched bar coater. The coating was allowed to air dry for about 10 minutes, dried for about 5 minutes at 70° C. and dried further for about 2 minutes at a temperature of 175° C. A sheet of unprimed uncoated polyester liner 2 mils (50 micrometers) in thickness was laminated to the Q2-7406 coating. The thickness of the Q2-7406 dry film was measured and found to be 2.1 mils (53 micrometers).

EXAMPLE 3

X2-7735 brand silicone pressure-sensitive adhesive solution (Dow Corning Corp. of Midland, Mich.) was handspread as supplied in xylene solution onto a fluoropolymer release coated polyester liner (SCOTCHPAK TM 1022 release liner available from the Minnesota Mining and Manufacturing Company, St. Paul, Minn.) using a notched bar coater. The coating was allowed to air dry for about 10 minutes, dried for about 5 minutes at 70° C. and dried further for about 2 minutes at a temperature of 175° C. A sheet of unprimed uncoated polyester liner 2 mils (50 micrometers) in thickness was laminated to the X2-7735 coating. The thickness of the X2-7735 dry film was measured and found to be 3.0 mils (76 micrometers).

EXAMPLE 4

X2-7735 brand silicone pressure-sensitive adhesive solution (Dow Corning Corp. of Midland, Mich.) was mixed with a solution of 10 wt % benzoyl peroxide in xylene so as to produce a solution with a benzoyl peroxide content of 1 wt % based on X2-7735 solution (about 2 wt % based on adhesive solids). This solution was handspread coated onto a fluoropolymer release coated polyester liner (SCOTCHPAK TM 1022 release liner available from the Minnesota Mining and Manufacturing Company, St. Paul, Minn.) using a notched bar coater. The coating was allowed to air dry for about 10 minutes, dried for about 5 minutes at 70½° C. and dried further for about 2 minutes at a temperature of 175° C. A sheet of unprimed uncoated polyester liner 2 mils (50 micrometers) in thickness was laminated to the X2-7735 coating. The thickness of the X2-7735 dry film was measured and found to be 1.9 mils (48 micrometers).

EXAMPLE 5

X2-7656 silicone pressure-sensitive adhesive solution (Dow Corning Corp. of Midland, Mich.) was mixed with a solution of 10 wt % platinum catalyst (#7127 Accelerator also available from Dow Corning Corp. of Midland, Mich.) in xylene so as to produce a solution with a platinum catalyst content of 1 wt % based on X2-7656 solution (about 2 wt % based on adhesive solids). This solution was handspread coated onto a fluoropolymer release coated polyester liner (SCOTCHPAK TM 1022 release liner available from the Minnesota Mining and Manufacturing Company, St. Paul, Minn.) using a notched bar coater. The coating was allowed to air dry for about 10 minutes, dried for about 5 minutes at 70½° C. and dried further for about 2 minutes at a temperature of 175½° C. A sheet of unprimed uncoated polyester liner 2 mils in thickness was laminated to the X2-7656 coating. The thickness of the X2-7656 dry film was 3.0 mils (76 micrometers).

EXAMPLE 6

Rubber resin adhesive used in pavement marking tapes (3M brand STAMARK TM 5730 series pavement marking tapes available from the Minnesota Mining and Manufacturing Company, St. Paul, Minn.) was handspread coated as supplied in heptane solution onto a fluoropolymer release coated polyester liner (SCOTCHPAK TM 1022 release liner available from the Minnesota Mining and Manufacturing Company, St. Paul, Minn.) using a notched bar coater. The coating was allowed to air dry for about 10 minutes, dried for about 5 minutes at 70½° C. and dried further for about 2 minutes at a temperature of 150½° C. A sheet of unprimed uncoated polyester liner 2 mils (50 micrometers) in thickness was laminated to the rubber resin adhesive coating. The thickness of the resulting adhesive dry film was 1.9 mils (48 micrometers).

TESTING OF EXAMPLES 1–6

Examples 1–6 were tested for peel and tack properties at both 21½° C. and −1½° C. Peel tests were performed at 15.4 inches per minute (38.4 cm/min) pull rate with both 5 and 60 minute dwell times at a 90½ peel angle. The tack tests were performed at a pull rate of 21.4 inches per minute (54 cm/min) in a twin cylinder tack testing apparatus as described above. The results are presented in Table 1.

EXAMPLE 7

Q2-7406 brand silicone pressure-sensitive adhesive (available from Dow Corning Corp. of Midland, Mich.) was handspread coated as supplied in xylene solution onto an unprimed uncoated polyester liner 2 mils in thickness using a notched bar coater. The coating was allowed to air dry for about 10 minutes, dried for about 5 minutes at 70½° C. and dried further for about 2 minutes at a temperature of 150½° C. A sheet of fluoropolymer release coated polyester liner (SCOTCHPAK TM 1022 release liner which is available from the Minnesota Mining and Manufacturing Company, St. Paul, Minn.) was laminated to the Q2-7406 coating. The thickness of the Q2-7406 dry film was 2.4 mils (60 micrometers).

EXAMPLE 8

Rubber resin adhesive used in pavement marking tapes (3M brand STAMARK TM 5730 series available from the Minnesota Mining and Manufacturing Company, St. Paul, Minn.) was handspread coated as supplied in heptane solution onto an unprimed uncoated polyester liner 2 mils in thickness using a notched bar coater. The coating was allowed to air dry for about 10 minutes, dried for about 5 minutes at 70° C. and dried further for about 2 minutes at a temperature of 150° C. A sheet of fluoropolymer release coated polyester liner (SCOTCHPAK TM 1022 release liner available from the Minnesota Mining and Manufacturing Company, St. Paul, Minn.) was laminated the rubber resin coating. The thickness of the rubber resin dry film was 2 mils (51 micrometers).

TESTING OF EXAMPLES 7 AND 8

Examples 7 and 8 were tested for the range of arc of contact, $\beta$, which was observed as the samples were pulled through a twin cylinder tack testing jig at slow (54 cm/min) and fast (540 cm/min) rates at cold (−1° C.) and room temperatures (21° C.). The results are presented in Table 2 along with the force which was required to pull the samples through the nip. Note that the range of arc of contact observed for Example 7 is substantial even when pulled at a fast rate at cold temperatures indicating superior performance of a marker of this invention relative to a marker with a rubber-resin pressure sensitive adhesive coating. The force required to pull the samples also indicates the superiority of the silicone pressure sensitive adhesive coated sample of Example 7 to the rubber-resin pressure sensitive adhesive coating of Example 8.

Examples 7 and 8 were also tested using a rolling ball test adapted from ASTM D 3121 (TACK OF PRESSURE-SENSITIVE ADHESIVES BY ROLLING BALL) by substituting a glass ball weighing 2.2832 grams and having a diameter of 0.4772 inches (1.212 cm). The testing was performed at −1° C. and at 21° C. At 21° C., the rolling ball stopped at an average distance of 1.3 cm for Example 7 and 25.5 cm for Example 8. At −1° C., the rolling ball stopped at an average distance 2.5 cm for Example 7 but did not stop within 70 cm for Example 8. The relatively short stop distance of Example 7, at both room and cold temperatures indicates the superiority of markers according to the present invention.

EXAMPLE 9

A silicone pressure sensitive adhesive, X7-2675 (available from Dow Corning Corp. of Midland, Mich.) as supplied in about 50% solids solution in Freon TM solvent was spread using a hand operated notched bar coater to form an adhesive coating onto a fluoropolymer release coated polyester liner, (SCOTCHPAK TM 1022 Release Liner available from the Minnesota Mining and Manufacturing Company of St. Paul, Minn.). The coating was allowed to air dry at ambient conditions for about 10 minutes followed by about 10 minutes at 70° C. The coating had a dry film thickness of about 2 mils (51 micrometers).

The resulting silicone pressure sensitive adhesive film coating, with the release liner still in place, was laminated to the pressure sensitive adhesive coated surface, the bottom side of 3M brand STAMARK TM 5730 pavement marking tape, (available from Minnesota Mining and Manufacturing Company of St. Paul, Minn.). The release liner was stripped from the silicone pressure sensitive adhesive and the composite laminate pavement marking tape was applied to a traffic bearing pavement surface and tamped into place by conventional means.

EXAMPLE 10

A Silicone pressure sensitive adhesive, Q2-7406, (available from Dow Corning Corp. of Midland, Mich.) was coated as supplied onto a fluoropolymer release coated polyester liner (SCOTCHPAK TM 1022 Release Liner, available from Minnesota Mining and Manufacturing Company of St. Paul, Minn.) using a notched bar coated by means of hand spread coating techniques. The coating was allowed to air dry at ambient conditions for about 10 minutes followed by about 10 minutes at 70° C. and a further 2 minutes at about 175° C. The coating had a dry film thickness of about 2 mils (51 micrometers).

This silicone pressure sensitive adhesive film with release liner still in place was laminated to the pressure sensitive adhesive coated surface, the bottom side of a commercially available pavement marking tape with a rubber-resin pressure sensitive adhesive (3M Brand SCOTCHLANE TM 5710 pavement marking tape, available from the Minnesota Mining and Manufacturing Company of St. Paul, Minn.). The release liner was stripped from the silicone pressure sensitive adhesive and the composite laminate pavement marking tape was applied to a traffic bearing pavement surface and tamped into place by conventional means.

EXAMPLE 11

A Silicone pressure sensitive adhesive, Q2-7406, (available from Dow Corning Corp. of Midland, Mich.) was coated as supplied onto a fluoropolymer release coated polyester liner (SCOTCHPAK TM 1022 Release Liner, available from the Minnesota Mining and Manufacturing Company of St. Paul, Minn.) using a notched bar coater by means of hand spread coating techniques. The coating was allowed to air dry at ambient conditions for about 15 minutes followed by forced air drying for about 3 minutes at about 150° C. The coating had a dry film thickness of about 2.5 mils (63 micrometers). Two layers were laminated to produce a layer about 5 mils (125 micrometers) thick.

The resulting silicone pressure sensitive adhesive film with release liner still in place was laminated to the bottom side of a commercially available pavement marking tape which lacked a pressure-sensitive adhesive (3M Brand STAMARK TM 5760 pavement marking tape, available from the Minnesota Mining and Manufacturing Company of St. Paul, Minn.). The release liner was stripped from the silicone pressure sensitive adhesive and the composite laminate pavement marking tape was applied to a traffic bearing pavement surface and tamped into place by conventional means.

EXAMPLE 12

A silicone pressure sensitive adhesive, Q2-7406, (available from Dow Corning Corp. of Midland, Mich.) was coated as supplied onto a fluoropolymer release coated polyester liner (Scotchpak 1022 Release Liner, available from the Minnesota Mining and Manufacturing Company of St. Paul, Minn.) using a notched bar coater by means of hand spread coating techniques. The coating was allowed to air dry at ambient conditions for about 15 minutes followed by forced air drying for about 3 minutes at about 150° C. The coating had a dry film thickness of about 2 mils (51 micrometers).

EXAMPLE 13

The silicone pressure sensitive adhesive film of Example 12 with release liner still in place was laminated to the pressure sensitive adhesive coated surface (the bottom side of 3M Brand STAMARK TM 320 series pavement marking tape, available from the Minnesota Mining and Manufacturing Company of St. Paul, Minn.). The release liner was stripped from the silicone pressure sensitive adhesive and the composite laminate pavement marking tape was applied to a concrete pavement surface and tamped into place by conventional means.

EXAMPLE 14

The silicone pressure sensitive adhesive film of Example 12 with release liner still in place was laminated to the pressure sensitive adhesive coated surface (the bottom side of Flex-O-Line Brand Pavement Striping Tape, Wet Reflective, Construction, Economy, pavement marking tape, available from Lukens General Industries, Inc., Flex-O-Lite Division, of St. Louis, Mo.). The release liner was stripped from the silicone pressure sensitive adhesive and the composite laminate pavement marking tape was applied to a concrete pavement surface and tamped into place by conventional means.

EXAMPLE 15

The silicone pressure sensitive adhesive film of Example 12 with release liner still in place was laminated to 3 mil thick dead soft aluminum foil available from ALCOA of Pittsburgh, Pa. The release liner was stripped from the silicone pressure sensitive adhesive and the composite laminate was applied to a concrete pavement surface and tamped into place by conventional means used for pavement marking tapes.

EXAMPLE 16

A 3 mil thick layer of rubber resin adhesive (used in 3M brand SCOTCHLANE TM 5710 series pavement marking tapes available from the Minnesota Mining and Manufacturing Company of St. Paul, Minn.) on a release liner was laminated to a 3 mil (76 micrometer) thick sheet of dead soft aluminum foil available from ALCOA of Pittsburgh, Pa. The release liner was stripped from the rubber resin adhesive and the composite laminate was applied to a concrete pavement surface and tamped into place by conventional means used for pavement marking tapes.

EXAMPLE 17

A 3 mil thick layer of rubber resin adhesive (used in 3M brand SCOTCHLANE TM 5710 series pavement marking tapes, available from the Minnesota Mining and Manufacturing Company of St. Paul, Minn.) on a release liner was laminated to the pressure sensitive adhesive coated surface (i.e. the bottom side) of a commercially available pavement marking tape (3M brand STAMARK TM 320 series pavement marking tape, available from the Minnesota Mining and Manufacturing Company of St. Paul, Minn.). The release liner was stripped from the silicone pressure sensitive adhesive and the composite laminate pavement marking tape was applied to a concrete pavement surface and tamped into place by conventional means.

EXAMPLE 18

A 3 mil thick layer of rubber resin adhesive (used in 3M brand SCOTCHLANE TM 5710 series pavement marking tapes, available from the Minnesota Mining and Manufacturing Company of St. Paul, Minn.) on a release liner was laminated to the pressure sensitive adhesive coated surface (i.e. the bottom side) of a commercially available pavement marking tape (Flex-O-Line Brand Pavement Striping Tape, Wet Reflective, Construction, Economy, pavement marking tape, available from Lukens General Industries, Inc., Flex-O-Lite Division, of St. Louis, Mo.). The release liner was stripped from the silicone pressure sensitive adhesive and the composite laminate pavement marking tape was applied to a concrete pavement surface and tamped into place by conventional means.

TESTING OF EXAMPLES OF 13–18

Samples, sized 24 inches by 4 inches (61 cm by 10 cm) of marking sheets from Examples 13 through 18 and two commercially available pavement marking tapes which included dead soft aluminum foil conformance layers (STAMARK TM 320 available from the Minnesota Mining and Manufacturing Company, St. Paul, Minn. and Flex-O-Lite Economy brand pavement marking tape available from Lukens General Industries, St. Louis, Mo.) were applied to a concrete pavement surface having a temperature of about 45° F. (7° C.). The samples were tamped against the surface using a 3M Roller Tamper Cart (model RTC-2 available from the Minnesota Mining and Manufacturing Company, St. Paul, Minn.) loaded with 200 lbs (90 Kg). The samples were peeled, at 90° from the surface and rate of 152 inches per minute (3.86 cm/minute) 16 hours after. installation. The temperature during peeling was 37° F. (3° C.) The results are reported in Table 3. Note that the pavement markers of the present invention as represented by Examples 13 through 15 required consistent and desirably moderate force at 90° to peel from the pavement. At lower temperatures, Examples 16–18 would have decreased ability to form bonds and therefore lower peel values. Examples 13–15 would be less affected.

EXAMPLE 19

A raised pavement marker having a marker body with a generally planar bottom surface (such as, for example, the marker disclosed in the Heenan patent, U.S. Pat. No. 3,332,327, incorporated herein by reference) could be adapted for roadway application by lamination to a pressure-sensitive adhesive laminate prepared as follows:

Step 1

An acrylic pressure-sensitive adhesive transfer tape of about 5 mils (127 micrometers) in thickness (available from 3M Company, Industrial Specialties Division, part #F9775PC, Minnesota Mining and Manufacturing Company, St. Paul, Minn.) could be laminated to one side of a suitable deformable layer such as described in the Esmay patent, U.S. Pat. No. 4,415,615, incorporated herein by reference, and which is available from the Minnesota Mining and Manufacturing Company, Sumitomo 3M Division, as part number JT1400-7370-4. Lamination should be done at relatively light pressure, preferably about 8 to 10 lbs./in$^2$ (5.5–6.9 NT/cm$^2$).

Step 2

A polyorganosiloxane pressure-sensitive adhesive film could be prepared by coating Dow Corning polyorganosiloxane adhesive X7-2675 (available from Dow Corning Corp. of Midland, Mich.) onto a suitable fluoropolymer release coated film (such as 3M SCOTCHPAK 1022 Release liner available from Minnesota Mining and Manufacturing Company of St. Paul, Minn.). This adhesive solution should be coated to a thickness of about 6 mils (152 micrometers). It is then subjected to room temperature (65°–72° F. (18°–22° C.)) for 10 minutes followed by five minutes at 200° F. (93° C.). The final coating thickness should be about 3 mils (76 micrometers).

Step 3

To the other side of the conformance layer, the polyorganosiloxane adhesive (from Step 2) should be laminated using light pressure (8–10 lbs./in$^2$ (5.5–6.9 NT/cm$^2$)).

Step 4

For application to the bottom of the raised pavement marker the protective film could be removed from the acrylic pressure-sensitive adhesive and applied with pressure to the bottom of the marker, preferably with pressure greater than 10 lbs./in$^2$ (6.9 NT/cm$^2$).

For application to the road, the fluoropolymer release film could be removed from the polyorganosiloxane pressure-sensitive adhesive. The marker could be positioned with the polyorganosiloxane adhesive against the road surface. Pressure could be applied to the top of the raised pavement marker to facilitate adhesion to the road surface. Sufficient pressure could be exerted by simply standing on the marker for about 15 seconds.

EXAMPLE 20

A raised pavement marker without a generally planar bottom surface, the body of which has been previously described in the May patent, U.S. Pat. No. 4,875,798, incorporated by reference herein, could also be prepared. In preparing such a raised pavement marker, it is preferable to use a conformance material having greater resistance to penetration than described in the Esmay patent, U.S. Pat. No. 4,415,615, incorporated by reference herein. A suitable conformance layer for such markers would be Acrylic Foam Tape 5390 (available from 3M Company, Automotive Engineered Systems Division, St. Paul, Minn.). The acrylic foam tape has been previously described in the Levens patent, U.S. Pat. No. 4,223,067, incorporated by reference herein and could be substituted into the method of Example 19.

In another embodiment, a pavement marker including an object (such as a pavement marking sheet or a raised pavement marker) may also be supported at the lower surface of the object by a deformable layer and a pressure-sensitive adhesive layer underlying the deformable layer. The deformable layer promotes contact between the underlying pressure sensitive adhesive layer and the roadway surface during and after installation. In the case of a rigid marker, it fills the space between the road surface and the marker. In the case of a flexible object such as a sheet, it compensates for deficiencies in deformability of the sheet.

Although the present invention has been described with reference to the preferred embodiments, workers skilled in the art will recognize the changes may be made in form and detail without departing from the spirit and scope of the invention.

TABLE 1

| SAMPLE | PEEL −1° C. with dwell 5/60 min | PEEL 21° C. with dwell 5/60 min | TACK −1° C. | TACK 21° C. |
|---|---|---|---|---|
| Example 1 | 0.09/0.30 (0.16/0.53) | 0.78/1.68 (1.37/2.94) | 0.50 (0.88) | 1.55 (2.71) |
| Example 2 | 0.02/0.10 (0.04/0.18) | 0.13/0.25 (0.23/0.44) | 0.35 (0.61) | 0.48 (0.84) |
| Example 3 | 0.10/0.13 (0.18/0.23) | 1.23/2.35 (2.15/4.11) | 0.45 (0.79) | 1.60 (2.80) |
| Example 4 | 0.03/0.13 (0.05/0.23) | 0.09/0.23 (0.16/0.40) | 0.25 (0.44) | 0.25 (0.44) |
| Example 5 | 1.50/1.28 (2.63/2.24) | 1.83/2.00 (3.20/3.50) | 1.30 (2.28) | 2.20 (3.85) |
| Example 6 | 0.43/1.05 (0.75/1.84) | 0.60/0.80 (1.05/1.40) | 0.35 (0.61) | 0.60 (1.05) |

Units = lbs/in width & (NT/cm width)

TABLE 2

| SAMPLE | PULL RATE | β @−1° C. | β @21° C. | TACK @−1° C. | TACK @21° C. |
|---|---|---|---|---|---|
| Example 7 | 54 cm/min | 45–90° | 85–90° | 1.6 | 2.3 |
| | 540 cm/min | 35–55° | 80–85° | 0.7 | 2.6 |
| Example 8 | 54 cm/min | 25–35° | 80–85° | 0.5 | 1.4 |
| | 540 cm/min | 10–20° | 45–50° | 0.4 | 1.1 |

Note:
TACK reported in NT/cm width

TABLE 3

| Sample | Peel Force lbs/4 inch width (NT/cm width) |
|---|---|
| Example 13 | 1.20 (0.52) |
| Example 14 | 1.00 (0.44) |
| Example 15 | 1.40 (0.61) |
| Example 16 | 3.05 (1.34) |
| Example 17 | 2.35 (1.03) |
| Example 18 | 1.75 (0.76) |
| Comparison Examples: | |

TABLE 3-continued

| Sample | Peel Force lbs/4 inch width (NT/cm width) |
|---|---|
| (Commercially Available Foil Pavement Tapes) | |
| STAMARK TM 320 (3M) | 0.75 (0.33) |
| Flex-O-Line (Lukens) | 0.15 (0.07) |

What is claimed is:

1. A pavement marker having an upper surface useful as a pavement marking indicium and comprising a layer of polyorganosiloxane pressure-sensitive adhesive wherein said adhesive is characterized by a 90° peel strength of from 1.8 to 10.5 Newtons per centimeter width from stainless steel at a peel rate of 54 centimeters per minute at 21° C. and more than 0.4 Newton per centimeter width at 2° C. when coated as a 76 micrometer layer on a 51 micrometer polyester backing.

2. A pavement marker having an upper surface useful as a pavement marking indicium and comprising a layer of polyorganosiloxane pressure-sensitive adhesive wherein said adhesive is characterized by at least about a 40° arc of contact $\beta$ with a steel cylinder in a twin cylinder tack test at a pull rate of 54 centimeters per minute at −1° C. when coated as a 76 micrometer layer on a 51 micrometer polyester backing.

3. A pavement marker having an upper surface useful as a pavement marking indicium and comprising a layer of polyorganosiloxane pressure-sensitive adhesive wherein said adhesive is characterized by a twin cylinder tack strength, during a 54 centimeters per minute pull in a standard tensile strength measuring device, of at least 1.3 Newtons per centimeter width at 21° C. and at least 0.8 Newton per centimeter at 2° C., when coated as a 76 micrometer layer on 51 micrometer polyester backing.

* * * * *

UNITED STATES PATENT AND TRADEMARK OFFICE
CERTIFICATE OF CORRECTION

PATENT NO. : 5,310,278

DATED : May 10, 1994

INVENTOR(S) : James M. Kaczmarczik et al.

It is certified that error appears in the above-identified patent and that said Letters Patent is hereby corrected as shown below:

In Column 9, line 42, "60½°" should read —60°—.

In Column 12, line 20, "70½°C" should read —70°C—.

In Column 12, line 41, "70½°C" should read —70°C—.

In Column 12, line 42, "175½°C" should read —175°C—.

In Column 12, line 58, "70½°C" should read —70°C—.

In Column 12, line 59, "150½°C" should read —150°C—.

In Column 12, line 67, "21½°C" should read —21°C—.

In Column 12, line 67, "-1½°C" should read — -1°C—.

In Column 13, line 1, "90½" should read —90°—.

In Column 13, line 14, "70½°C" should read —70°C—.

In Column 13, line 15, "150½°C" should read —150°C—.

In Column 14, line 36, the word "coated" should read —coater—.

In Column 16, line 59, delete the period after the word "after".

Signed and Sealed this

First Day of November, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO.: 5,310,278

DATED: May 10, 1994

INVENTOR(S): James M. Kaczmarczik, et al.

It is certified that error appears in the above-identified patent and that said Letters Patent is hereby corrected as shown below:

In Column 10, line 55, delete "F9775PC" and insert - - F9755PC - -.

In Column 11, line 1, delete "F9775PC" and insert - - F9755PC - -.

In Column 17, line 15, delete "F9775PC" and insert - - F9755PC - -.

Signed and Sealed this

Twentieth Day of October, 1998

*Attest:*

*Attesting Officer*

Bruce Lehman

BRUCE LEHMAN

*Commissioner of Patents and Trademarks*